United States Patent [19]

Ffooks et al.

[11] 4,109,823

[45] Aug. 29, 1978

[54] INSULATION SYSTEM FOR LIQUEFIED GAS TANKS

[75] Inventors: Roger Cambridge Ffooks, Tittlesfold Farm, near Billingshurst, England; Hiroshi Komada, Kobe, Japan

[73] Assignee: Conch LNG, Moorestown, N.J.

[21] Appl. No.: 740,818

[22] Filed: Nov. 11, 1976

[30] Foreign Application Priority Data

Nov. 22, 1975 [GB] United Kingdom ..... 48119/75

[51] Int. Cl.[2] ..... B65D 87/24; B65D 87/34

[52] U.S. Cl. ..... 220/446; 220/456; 220/460; 220/901

[58] Field of Search ..... 220/9 A, 9 F, 9 LG, 220/10, 15

[56] References Cited

U.S. PATENT DOCUMENTS

| | | | |
|---|---|---|---|
| 3,595,424 | 7/1971 | Jackson | 220/15 X |
| 3,757,982 | 9/1973 | Isenberg et al. | 220/9 LG X |
| 3,922,987 | 12/1975 | Tornay | 220/9 LG X |
| 3,929,247 | 12/1975 | Borup | 220/9 LG |
| 3,931,908 | 1/1976 | Cheyney | 220/9 LG X |

FOREIGN PATENT DOCUMENTS

| | | | |
|---|---|---|---|
| 694,444 | 9/1964 | Canada | 220/15 |

*Primary Examiner*—Stephen Marcus
*Attorney, Agent, or Firm*—Schiller & Pandiscio

[57] ABSTRACT

The invention relates to liquefied gas containers, particularly liquefied gas ships, having a foamed plastics insulation system. The invention provides an arrangement for the corners/top edge of the insulation in which the foam plastic insulation material for each wall area is foamed onto a rigid outer support shell so that it stops just short of the corners/top edge of said shell. The edges of the foam are anchored by reinforcement mesh or the like bonded to the inner face of the foam, the mesh extending over the edges of the foam and being bonded by adhesive into the shell corners. In the case of the corners, a coving is laid across each corner and is bonded to the inner faces of the adjacent wall areas. Further foamed insulation is then built up behind the coving to the required thickness.

6 Claims, 4 Drawing Figures

INSULATION SYSTEM FOR LIQUEFIED GAS TANKS

The present invention relates to thermally-insulated containers and has particular, although not exclusive, application to the overwater transportation of liquefied gas, especially liquefied natural gas in ocean going tankers.

It is known to transport liquefied natural gas in double-hulled tankers in which self-supporting aluminium alloy cargo tanks are maintained in position independently of the tanker's hulls by support pads of balsa or plywood bearing on the floor of the inner hull. The inner hull is lined internally with a layer of polyurethane foam adhered to said hull and covered with an inner layer of fiber glass, the inner surface of which fiber glass layer is spaced from the cargo tank. The polyurethane foam has adequate density, stability, strength, impermeability and resistance to cracking to act as a fluid-tight secondary barrier to protect the hull should the cargo tank spring a leak. However, the foam has a sufficiently large coefficient of thermal expansion to tend, when cooled by the presence of liquefied natural gas in the cargo tank, to shrink away from the inner hull at angular corners thereof. This problem has previously been overcome by providing in said corners, prior to application by spraying of the polyurethane layer, a frame of load bearing insulation in the form of composite ribs of plywood to provide additional keying surface area for the foam.

Such an arrangement is disclosed in our British Patent No. 1203496 and in its Patent of Addition Specification No. 1301368. Whilst such an arrangement provides an efficient thermal insulation system capable of acting as a secondary barrier, the cost of constructing the load-bearing frame (which is very labour intensive) is high in comparison with the costs of applying the foam insulation.

In order to achieve a considerable cost saving for this thermal insulation system, it has been proposed in British Patent Application No. 35094/74 to replace the composite ribs discussed above with "load-bearing" sheet material extending across the respective corners to present a concavely curved surface to the polyurethane foam layer instead of the angular corner of the inner hull.

In the preferred embodiment of the said co-pending patent application, this is achieved by the use of a resilient part-cylindrical plate of the same material as the container, which is welded across the corners of the container to present a concavely curved surface, over which foam is applied in sprayed layers.

An object of the invention is to provide an alternative arrangement for the corners of the thermal insulation system.

A further object of the invention is to provide a top edge for the thermal insulation system which is anchored to the shell.

According to one aspect of this invention, in a thermally-insulated container of the kind in which the thermal insulation is provided on the inner faces of an outer prismatic rigid shell and comprises one or more layers of foam plastic insulation material sprayed in situ onto said shell, the wall areas of the container have the plastics material applied thereto in layers in a manner known per se, which layers extend up to a level defining the top edge of the container, the layers being covered along the top edge by reinforcing sheet material, which extends beyond the extent of the edge and is rigidly affixed directly to the rigid shell above the top edge whereby to tie back and anchor the latter.

According to another aspect of this invention in a thermally-insulated container of the kind in which the thermal insulation is provided on the inner faces of an outer prismatic rigid shell and comprises one or more layers of foam plastic insulation material sprayed in situ onto said shell, the wall areas of the container have the foam plastic insulation material applied thereto in layers in a manner known per se, which layers stop short of at least all but the uppermost corners of the shell and are wholly or partly covered by reinforcing sheet material, which material extends beyond the extent of the foreshortened edges of said layers and is rigidly affixed to the adjacent corners of the shell whereby to tie back and anchor said edges to said shell, and further reinforcing sheet material is provided as strips which are affixed across adjacent wall areas of insulation so as to provide a coving behind which further foam plastic insulation material is contained to provide a required thickness of thermal insulation at said corners.

As mentioned above, the invention has particular application to the inner hull of a double-hulled tanker of the kind previously referred to. It will be apparent however that it has other applications especially to the storage of liquefied gas in land tanks in which a liquefied gas is contained within a storage tank located within a heat-insulated container. In certain applications, the thermal insulation of the container may be in direct contact with the liquid to be stored or transported.

The nature and identity of the thermally-insulating material will be chosen having regard to the intended use of the container of the invention, for example, as discussed at length in British Patent Application No. 37204/75. In the case of containers intended to accommodate a liquefied gas-containing tank the material will be suitable for cryogenic insulation, for example foamed closed cell polyurethane, whilst the sheets of reinforcing material may be of fiber glass cloth.

It will be appreciated that the invention includes within its scope, the method by which the thermal insulation is applied.

According to a further aspect of the invention, in a method of forming the corners of the insulation of a thermally-insulated container of the kind specified above, a gap is left along each corner after the reinforcing sheet material has been tied back to the shell, a coving of reinforcing sheet material is extended across and bonded to the adjacent wall areas of insulation and the closed space provided between the corner of the shell, and said space is filled with further foam plastic insulation material.

In one preferred method an inflatable former is located in each gap such that a closed space is left between the shell corner and the former when the latter is inflated, which space is filled with foam plastic insulation material, either by foaming or pouring in place, the former is deflated after the plastic has cured, and removed, and the face of the cured plastic is covered by reinforcing sheet material, the opening of the partly filled gap then being covered by further reinforcing sheet material, and further foam plastic insulation material being foamed or poured into the closed space so provided.

In order that the invention may be readily understood, and further features made apparent, a thermally insulated container constructed in accordance therewith will now be described, by way of example, with reference to the accompanying drawings, in which.

Figure 1:
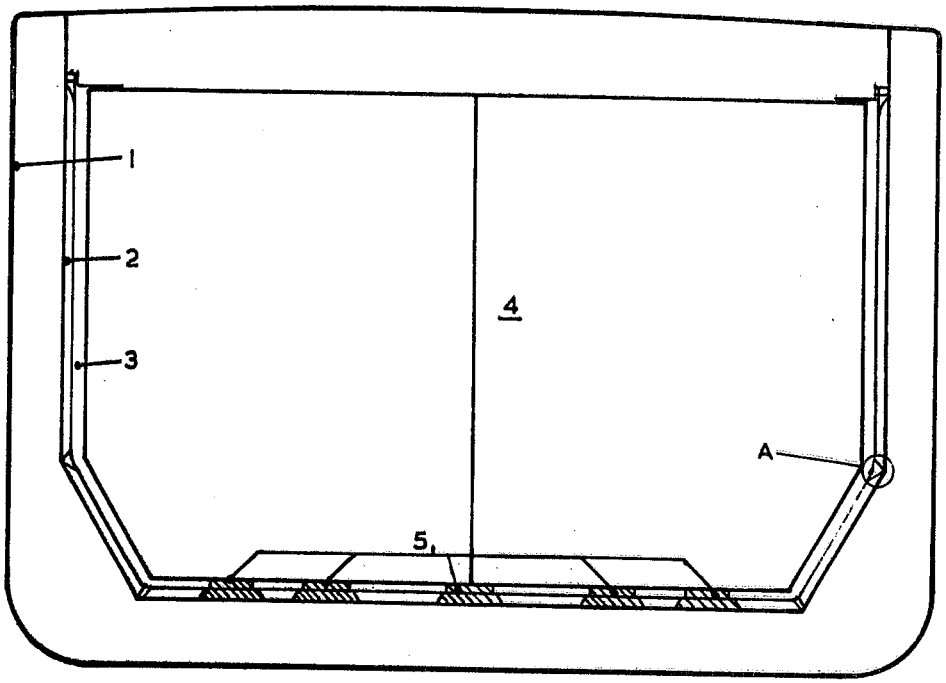
FIG. 1 is a diagrammatic transverse section through an LNG tanker, showing a thermally insulated cargo-hold.

Referring to FIG. 1, the tanker comprises an outer hull 1, and an inner hull 2 spaced therefrom, which is divided longitudinally into a number of cargo holds 3 by transverse cofferdams (not shown). Each cargo hold is lined internally by thermal insulation and in a manner known per se, for example from out British patent specification No. 1203496, the major wall areas of each cargo hold are covered by a number of layers of sprayed on foam plastic insulation material. The foam plastic is preferably closed cell polyurethane material of special formulation, for example as described and claimed in British Patent Application No. 37204/75.

Also, in a manner known per se, for example from British Pat. No. 1300730, each cargo hold 3 contains a self-supporting tank 4 which rests on specially designed support pads 5 of load-bearing thermal insulation material forming part of the bottom layer of insulation.

Figure 2:
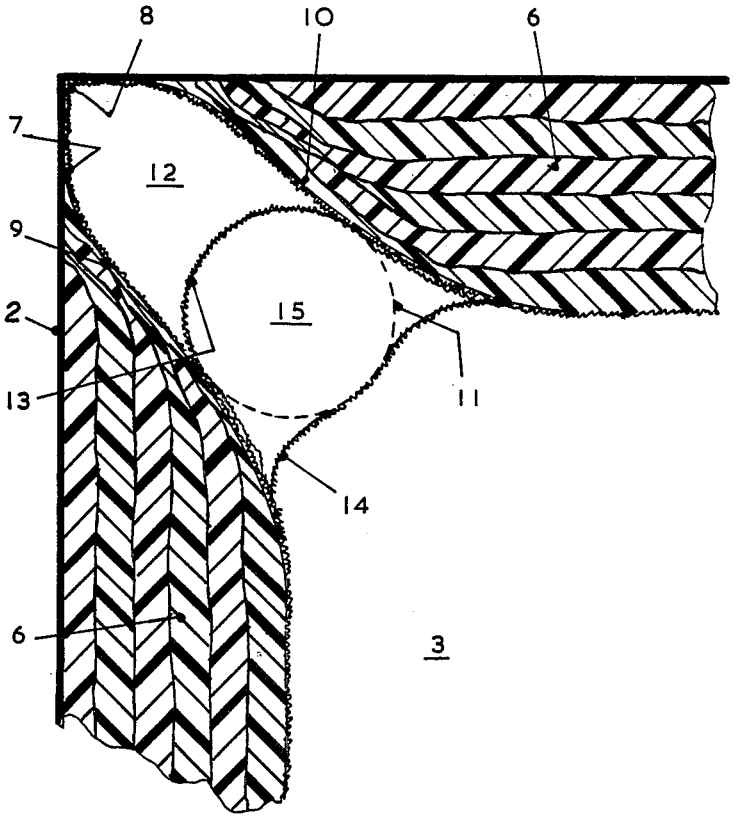
FIG. 2 is an enlarged view of a vertical right angled corner of the cargo hold.

Referring to FIG. 2, it will be seen that the layers 6, of foamed polyurethane forming a major portion of the wall areas stop just short of the vertical corners 8 of the cargo hold 3, and that the edges 9, 10 of the layers of adjacent wall areas are tapered so as to leave a gap between said wall areas extending back into the angle of the corner 8. The inner faces of the wall areas of foam are strengthened by reinforcement sheets 7, preferably of fiber glass cloth of an open mesh weave, which is adhered to said inner faces and to the tapered edges thereof, and also extend over the tapered and foreshortened edges of their respective wall areas of foam and into the corners 8 of the cargo hold; the extended edges of the sheet material are bonded directly to the steelwork of said corners, for example by use of a polyurethane adhesive. The edges 9, 10 of the foam layers are thus tied back and anchored to the vertical corners of the cargo hold. To fill the gap left along the line of the vertical corners between adjacent wall areas, an elongated inflatable former 11 is inserted partly into the gap and inflated (as shown dotted). The closed space so provided between each corner 8 and the former 11 is then poured or foamed with polyurethane 12 and, when this has cured, the former 11 is deflated. The face of the cured polyurethane is then covered by an intermediate layer 13 of reinforcement fiber glass cloth, which is extended so as to be bonded to the adjacent tapered edges 9, 10. After this, the former 11 is re-inserted and inflated and a further coving strip of reinforcing fiber glass cloth 14 is extended over the former and bonded to the inner faces of the adjacent wall areas. The former 11 is then again deflated and removed to provide another closed space into which further polyurethane 15 is foamed; the gap between adjacent wall areas is thus filled over its entire depth. It will be appreciated that if the intermediate layer 13 is not required, the former 11 need be inflated once only, in which case, the coving strip 14 would be applied at this time. To ensure that the former 11 does not adhere to the insulation whilst inflated, it may be coated with a "Release" agent.

Figure 3:
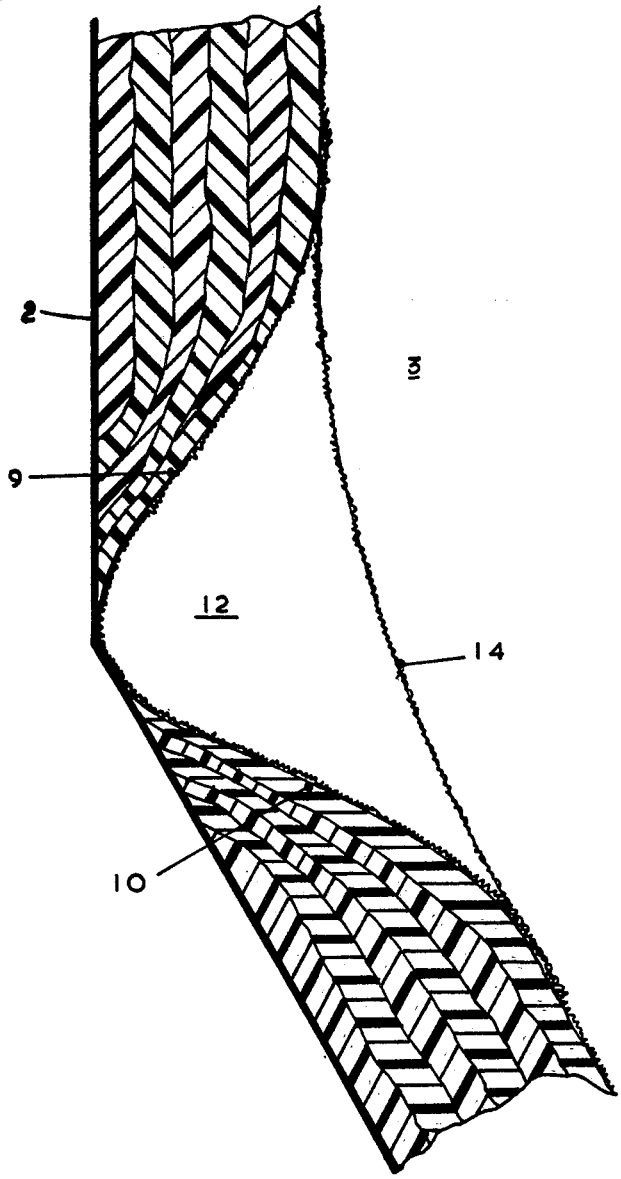
FIG. 3 is an enlarged view of the corner marked "A" in FIG. 1.

Referring to FIG. 3, the make up of this chamber corner is much as described with reference to FIG. 2. However, because of its obtuse angle, no inflatable former is used, the coving strip 14 being laid over to bridge the gap between adjacent wall areas and to be bonded thereto. Also, no intermediate reinforcing layer 12 is used.

Figure 4:
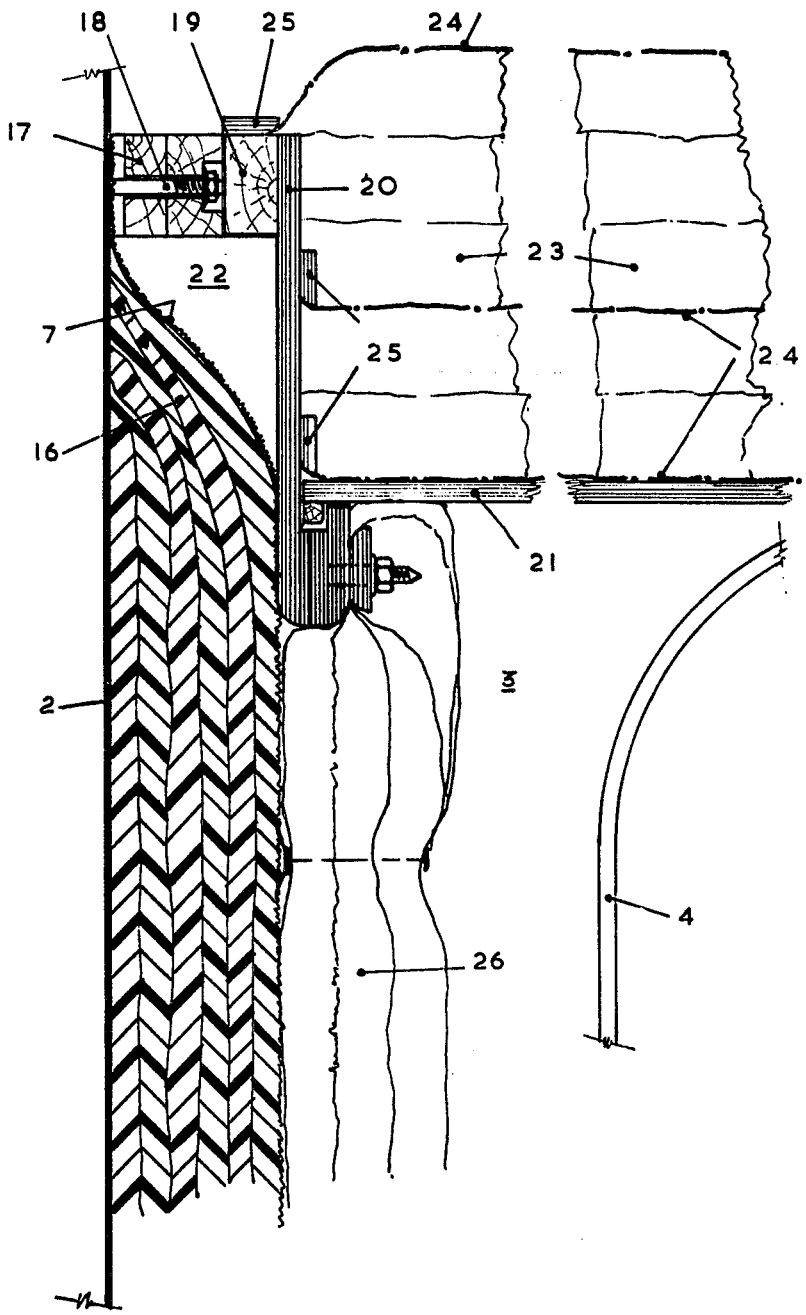
FIG. 4 is an enlarged view of the top edge arrangement of the thermal insulation.

Referring now to FIG. 4, the top edges 16 of the wall areas of the insulation are tapered, and the reinforcement mesh 7 is bonded onto the steelwork, much as described hereinbefore. However, wooden grounds 17 are tightened over the ends of the reinforcement fiber glass cloth 7, via studs 18, which grounds support a continuous hanger structure comprising a block 19 and a vertically arranged hanger board 20. At its lower end, the board 20 rests against the inner face of the thermal insulation and supports a plywood flap 21 which bridges the space between the inner face of the insulation and the top of the tank 4. The roughly triangular space left between the edge 16 of the insulation, grounds 17, and hanger board 20, is filled with compressed fibrous glass wool 22. The top of the tank 4 is covered by a number of layers 23 of compressed fiber glass wool, and three convection barriers 24 (preferably comprising sheets of reinforced paper) are provided through the thickness to prevent gas from circulating up through the insulation; the lowermost barrier 24 also acts as a "splash" barrier. Each barrier 24 is affixed around its edges by battens 25. It will be seen from FIG. 4, that the wall insulation may be increased by hanging further layers 26 of fiber glass wool from the hangers 20 in the space beneath the plywood flap 21.

It will be appreciated that modifications of the arrangements described herein can be carried out within the scope for the appended Claims. For example, in an alternative arrangement, the gap left along the line of the corners, may be filled by spraying the polyurethane 12 in layers along each gap up to the required overall thickness before the coving of reinforcing fiber glass cloth is applied. Thus, after spraying has been completed along the gaps, the face of the polyurethane may be smoothed and trimmed if required and the coving 14 bonded over this face and the faces of the adjacent wall areas of the insulation. It will be appreciated that the method of application would dispense altogether with the need for an inflatable former 11.

As described above, this embodiment provides a thermal insulation system acting as a secondary barrier, the primary barrier being the tank 4.

Also as described above, the system could provide primary and secondary barriers, in which case the secondary barrier would be provided within the total thickness of the sprayed insulation. With such an arrangement both barriers would be completed by a suitable closely woven film of epoxy resin or fiber glass cloth reinforcement as described hereinbefore. Alternatively the reinforcement sheet could be formed by spraying onto the foam. In this case the sheet would preferably comprise chopped strands of epoxy resin material which, when cured, would provide an impenetrable barrier.

We claim:

1. A thermally-insulated container of the type comprising (1) an outer prismatic rigid shell having (2) at least one layer of foam plastic thermal insulation material (a) sprayed in situ onto the vertical inside wall surfaces of said shell, (b) at least one of said at least one layers of foam plastic insulation material extending vertically upward to a level which defines the top edges of said container, and (3) flexible reinforcing sheet material (a) rigidly adhered to the side wall surface areas of said foam plastic insulation material, portions of said flexible reinforcing sheet material (b) projecting beyond said top edges, and (c) rigidly affixed directly to said rigid shell above said top edges.

2. A container according to claim 1, and including grounds fixed along the line of said top edges and overlapping the projecting portions of said reinforcing sheet material, said grounds supporting a continuous hanger structure which supports further layers of performed insulation over said side wall surface areas of said foam plastic insulation material.

3. A container according to claim 1, wherein the uppermost edges of said foam plastic insulation material are tapered towards said rigid shell.

4. A thermally-insulated container of the type comprising (1) an outer prismatic rigid shell having (2) at least one layer of a foam plastic insulation material (a) sprayed in situ onto the vertical inside wall surfaces of said shell (b) but stopping short of at least all but the uppermost corners of said shell, the inside wall surfaces of said foam plastic insulation material being (c) covered at least in part by (3) a flexible reinforcing sheet material, said sheet material (a) being rigidly adhered to said foam inside wall surfaces, and (b) portions of said flexible reinforcing material projecting beyond said uppermost corner edges of said foam plastic insulation material, said projecting portions being (c) rigidly affixed to their respective adjacent corners of said shell, and including (4) additional flexible reinforcing sheet material (a) in the form of strips which are (b) affixed across adjacent vertical wall areas of said foam plastic insulation so as to define an opening along the length of said corners, and (5) additional foam plastic insulation material contained in said openings whereby to provide a desired thickness of foam plastic thermal insulation in said corners.

5. A container according to claim 4, wherein said additional foam plastic material filling the gap of each corner comprises at least two layers, and including reinforcing sheet material between layers bonded to said reinforcing sheet material of said adjacent wall areas of insulation.

6. A container according to claim 4, wherein the uppermost edges of said foam plastic insulation material are tapered towards said rigid shell.

* * * * *

UNITED STATES PATENT AND TRADEMARK OFFICE

CERTIFICATE OF CORRECTION

PATENT NO. : 4109823

DATED : August 29, 1978

INVENTOR(S) : Roger Cambridge Ffooks et al

It is certified that error appears in the above-identified patent and that said Letters Patent are hereby corrected as shown below:

Claim 2, column 5, line 14 "performed"

should be changed to read --preformed--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*